US008752513B2

(12) United States Patent
Zurface et al.

(10) Patent No.: US 8,752,513 B2
(45) **Date of Patent: *Jun. 17, 2014**

(54) SWITCHING ROCKER ARM

(75) Inventors: Austin Zurface, Hastings, MI (US); Andrei Dan Radulescu, Marshall, MI (US); Majo Cecur, Rivarolo Canavese (IT); Philip M. Kline, Tekonsha, MI (US); Tony Gordon, South Boston, VA (US); James R. Sheren, Grand Ledge, MI (US)

(73) Assignee: Eaton Corporation, Cleveland, OH (US)

( * ) Notice: Subject to any disclaimer, the term of this patent is extended or adjusted under 35 U.S.C. 154(b) by 422 days.

This patent is subject to a terminal disclaimer.

(21) Appl. No.: 13/051,848

(22) Filed: Mar. 18, 2011

(65) Prior Publication Data

US 2011/0226209 A1 Sep. 22, 2011

Related U.S. Application Data

(60) Provisional application No. 61/315,464, filed on Mar. 19, 2010.

(51) Int. Cl.
*F01L 1/34* (2006.01)

(52) U.S. Cl.
USPC ..... 123/90.16; 123/90.44; 123/90.39

(58) Field of Classification Search
USPC ..... 123/90.16, 90.44, 90.39, 90.15, 90.1
See application file for complete search history.

(56) References Cited

U.S. PATENT DOCUMENTS

| | | | | |
|---|---|---|---|---|
| 6,932,041 | B1 * | 8/2005 | Riley | 123/90.44 |
| 7,562,643 | B2 * | 7/2009 | Akasaka | 123/90.16 |
| 7,677,213 | B2 * | 3/2010 | Deierlein | 123/90.16 |
| 7,987,826 | B2 * | 8/2011 | Kwak et al. | 123/90.16 |
| 2003/0192497 | A1 | 10/2003 | Hendriksma et al. | |
| 2003/0209217 | A1 | 11/2003 | Hendriksma et al. | |
| 2004/0074459 | A1 | 4/2004 | Hayman et al. | |
| 2005/0016480 | A1 | 1/2005 | Ferracin et al. | |
| 2005/0188930 | A1 | 9/2005 | Best | |

(Continued)

FOREIGN PATENT DOCUMENTS

| | | |
|---|---|---|
| DE | 102004017103 | 10/2005 |
| DE | 102006046573 | 4/2008 |

(Continued)

OTHER PUBLICATIONS

International Search Report issued by the European Patent Office; PCT/US2011/029065; Authorized Officer Paulson, B.; Issued Sep. 21, 2011 (3 pages).

(Continued)

*Primary Examiner* — Thai Ba Trieu
*Assistant Examiner* — Thomas Olszewski
(74) *Attorney, Agent, or Firm* — Remarck Law Group PLC

(57) ABSTRACT

A rocker arm for engaging a cam is disclosed. An outer arm and inner arm are configured to transfer motion to a valve of an internal combustion engine. A latching mechanism includes a latch, sleeve and orientation member. The sleeve engages the latch and a bore in the inner arm, and also provides an opening for an orientation member used in providing the correct orientation for the latch with respect to the sleeve and the inner arm. The sleeve, latch and inner arm have reference marks used to determine the optimal orientation for the latch.

20 Claims, 15 Drawing Sheets

(56) References Cited

U.S. PATENT DOCUMENTS

| | | | | |
|---|---|---|---|---|
| 2007/0039573 | A1 | 2/2007 | Deierlein | |
| 2007/0125329 | A1* | 6/2007 | Rohe et al. | 123/90.16 |
| 2007/0186890 | A1 | 8/2007 | Zurface et al. | |
| 2008/0149059 | A1 | 6/2008 | Murphy et al. | |
| 2009/0000882 | A1* | 1/2009 | Siebke | 188/73.45 |
| 2011/0226208 | A1 | 9/2011 | Zurface et al. | |

FOREIGN PATENT DOCUMENTS

| | | |
|---|---|---|
| DE | 102006057895 | 6/2008 |
| EP | 1785595 | 5/2007 |
| JP | 2008184956 A | 8/2008 |

OTHER PUBLICATIONS

Written Opinion issued by the European Patent Office; PCT/US2011/029065; Authorized Officer Paulson, B.; Issued Sep. 21, 2011 (6 pages).

International Search Report issued by the European Patent Office; PCT/US2011/029061; Authorized Officer Paulson, B.; Issued Sep. 21, 2011 (3 pages).

Written Opinion issued by the European Patent Office; PCT/US2011/029061; Authorized Officer Paulson, B.; Issued Sep. 21, 2011 (6 pages).

Office Action for related U.S. Appl. No. 13/051,839 dated Jun. 20, 2013.

* cited by examiner

SWITCHING ROCKER ARM

PRIORITY

This application claims priority to U.S. Provisional Application No. 61/315,464, filed Mar. 19, 2010. The entirety of that application is incorporated herein.

FIELD OF THE INVENTION

This application is directed to switching rocker arms for internal combustion engines.

BACKGROUND

Switching rocker arms allow for control of valve actuation by alternating between two or more states, usually involving multiple arms, such as in inner arm and outer arm. In some circumstances, these arms engage different cam lobes, such as low-lift lobes, high-lift lobes, and no-lift lobes. Mechanisms are required for switching rocker arm modes in a manner suited for operation of internal combustion engines.

SUMMARY

A rocker arm for engaging a cam is disclosed. An outer arm and inner arm are configured to transfer motion to a valve of an internal combustion engine. A latching mechanism includes a latch, sleeve and orientation member. The sleeve engages the latch and a bore in the inner arm, and also provides an opening for an orientation member used in providing the correct orientation for the latch with respect to the sleeve and the inner arm. The sleeve, latch and inner arm have reference marks used to determine the optimal orientation for the latch.

BRIEF DESCRIPTION OF THE DRAWINGS

It will be appreciated that the illustrated boundaries of elements in the drawings represent only one example of the boundaries. One of ordinary skill in the art will appreciate that a single element may be designed as multiple elements or that multiple elements may be designed as a single element. An element shown as an internal feature may be implemented as an external feature and vice versa.

Further, in the accompanying drawings and description that follow, like parts are indicated throughout the drawings and description with the same reference numerals, respectively. The figures may not be drawn to scale and the proportions of certain parts have been exaggerated for convenience of illustration.

DETAILED DESCRIPTION

Figure 1:
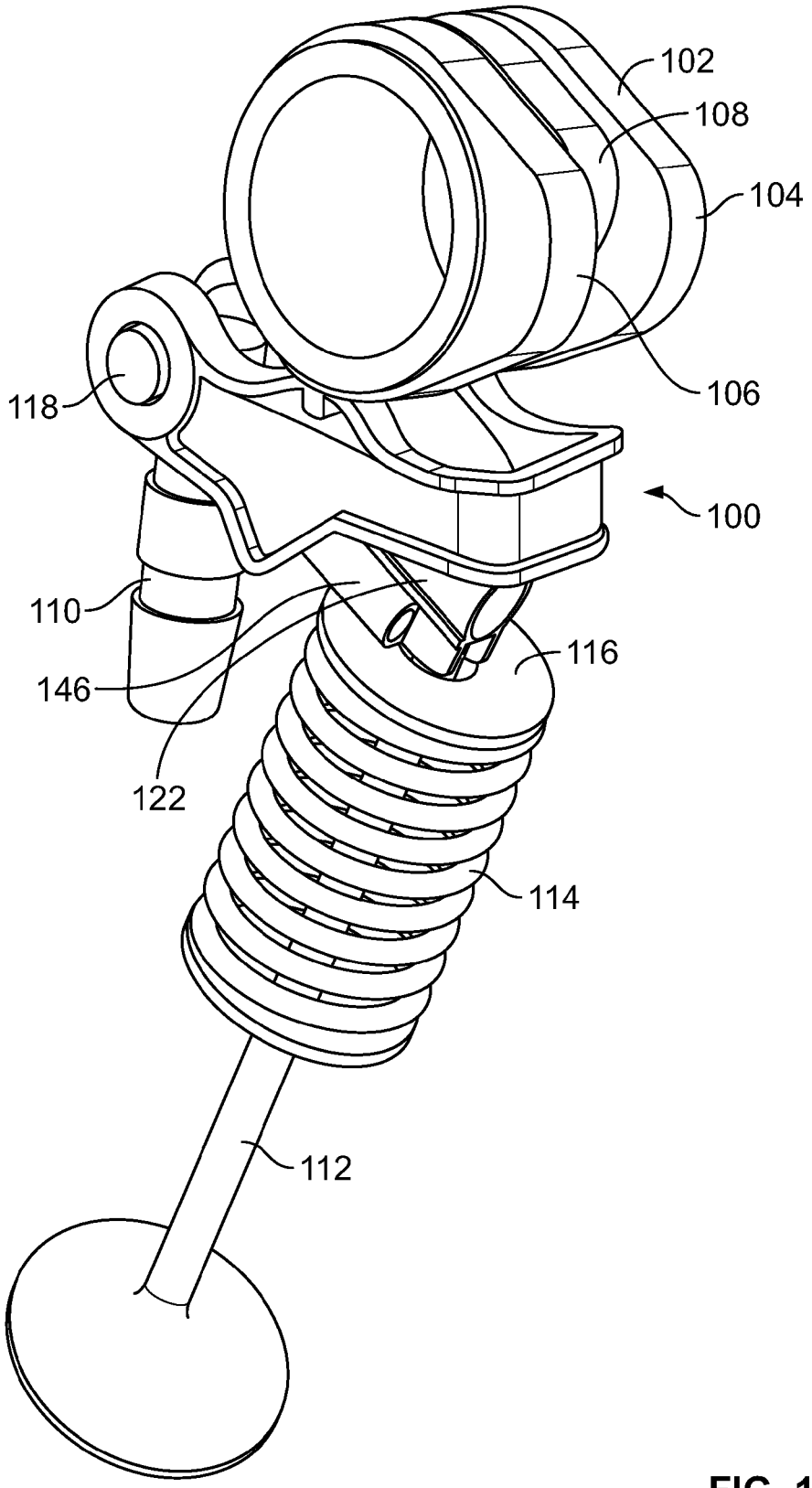
FIG. 1 illustrates a perspective view of an exemplary switching rocker arm 100 as it may be configured during operation with a three lobed cam 102.

Certain terminology will be used in the following description for convenience in describing the figures will not be limiting. The terms "upward," "downward," and other directional terms used herein will be understood to have their normal meanings and will refer to those directions as the drawing figures are normally viewed.

Figure 2:
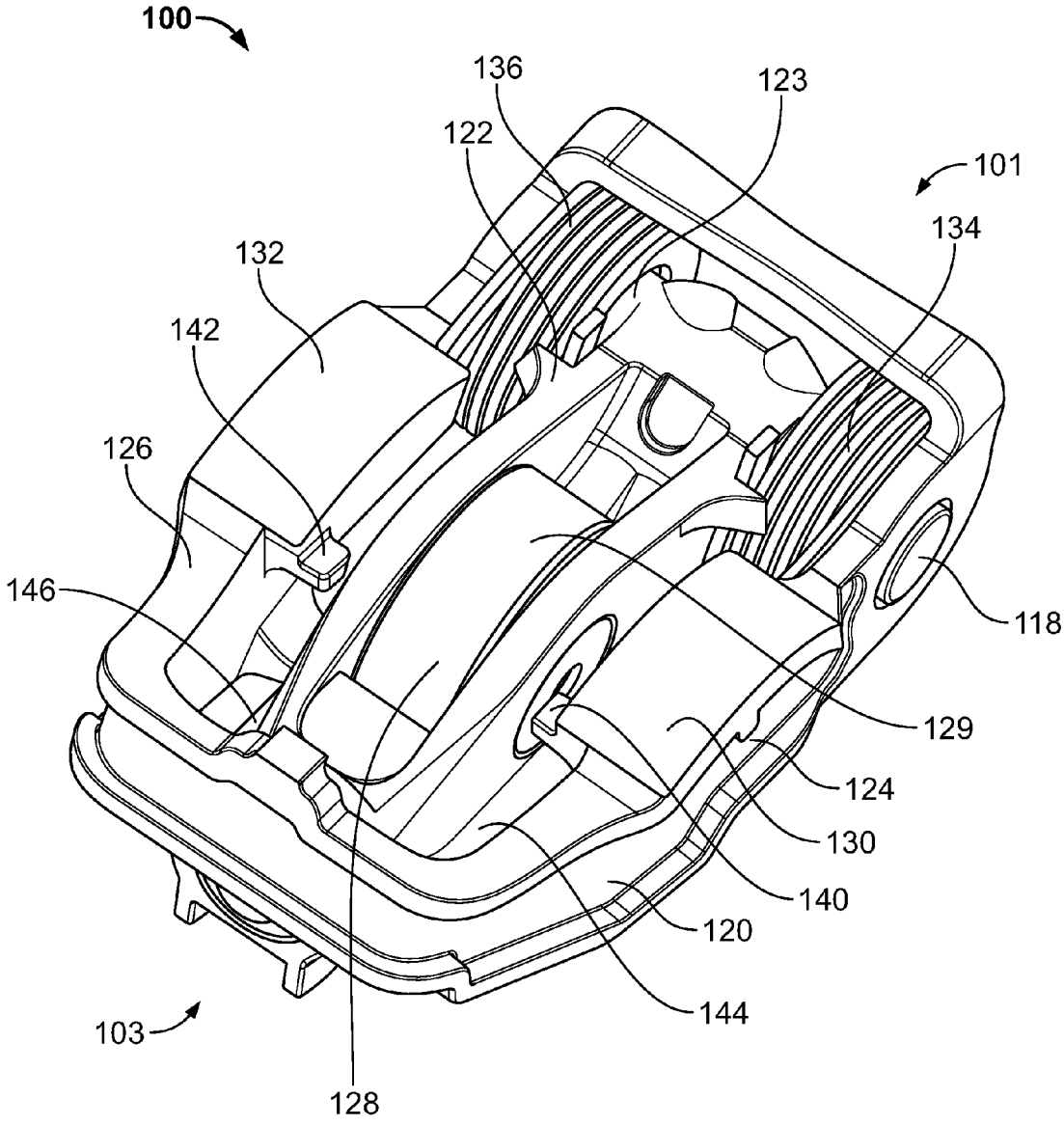
FIG. 2 illustrates a perspective view of an exemplary switching rocker arm 100.

FIGS. 1 and 2 illustrate a perspective view of an exemplary switching rocker arm 100 as it may be configured during operation with a three lobed cam 102, a lash adjuster 110, valve 112, spring 114 and spring retainer 116. The cam 102 has a first and second high-lift lobe 104, 106 and a low lift lobe 108. The switching rocker arm has an outer arm 120 and an inner arm 122. During operation, the high lift lobes 104, 106 contact the outer arm 120 while the low lift lobe contacts the inner arm 122. The lobes cause periodic downward movement of the outer arm 120 and inner arm 122. The downward motion is transferred to the valve 112 by inner arm 122, thereby opening the valve. Rocker arm 100 is switchable between a high lift mode to low lift mode. In the high lift mode, the outer arm 120 is latched to the inner arm 122. During engine operation, the high lift lobes periodically push the outer arm 120 downward. Because the outer arm 120 is latched to the inner arm 122, the high lift motion is transferred from outer arm 120 to inner arm 122 and further to the valve 112. When the rocker arm 100 is in its unswitched mode, the outer arm 120 is not latched to the inner arm 122, and so high lift movement exhibited by the outer arm 120 is not transferred to the inner arm 122. Instead, the low lift lobe contacts the inner arm 122 and generates low lift motion that is transferred to the valve 112. When unlatched from inner arm 122, the outer arm 120 pivots about axle 118, but does not transfer motion to valve 112.

FIG. 2 illustrates a perspective view of an exemplary switching rocker arm 100. The switching rocker arm 100 is shown by way of example only and it will be appreciated that the configuration of the switching rocker arm 100 that is the subject of this disclosure is not limited to the configuration of the switching rocker arm 100 illustrated in the figures contained herein.

As shown in FIG. 2, the switching rocker arm 100 includes an outer arm 120 having a first outer side arm 124 and a second outer side arm 126. An inner arm 122 is disposed between the first outer side arm 124 and second outer side arm 126. The inner arm 122 and outer arm 120 are both mounted to a pivot axle 118, located adjacent the first end 101 of the rocker arm 100, which secures the inner arm 122 to the outer arm 120 while also allowing a rotational degree of freedom about the pivot axle 118 of the inner arm 122 with respect to the outer arm 120. In addition to the illustrated embodiment having a separate pivot axle 118 mounted to the outer arm 120 and inner arm 122, the pivot axle 118 may be part of the outer arm 120 or the inner arm 122.

The rocker arm 100 illustrated in FIG. 2 has a roller 128 that is configured to engage a central low-lift lobe of a three-lobed cam. First and second slider pads 130, 132 of outer arm 120 are configured to engage the first and second high-lift lobes 104, 106 shown in FIG. 1. First and second torsion springs 134, 136 function to bias the outer arm 120 upwardly after being displaced by the high lift lobes 104, 106. First and second over-travel limiters 140, 142 prevent over-coiling of the torsion springs 134, 136 and exceeding the stress capability of the springs 134, 136. The over-travel limiters 140, 142 contact the first and second oil gallery 144, 146 when the outer arm 120 reaches its maximum rotation during low-lift mode. At this point, the interference between the over-travel limiters 140, 142 and the galleries 144, 146 stops any further downward rotation of the outer arm 120.

Figure 3:
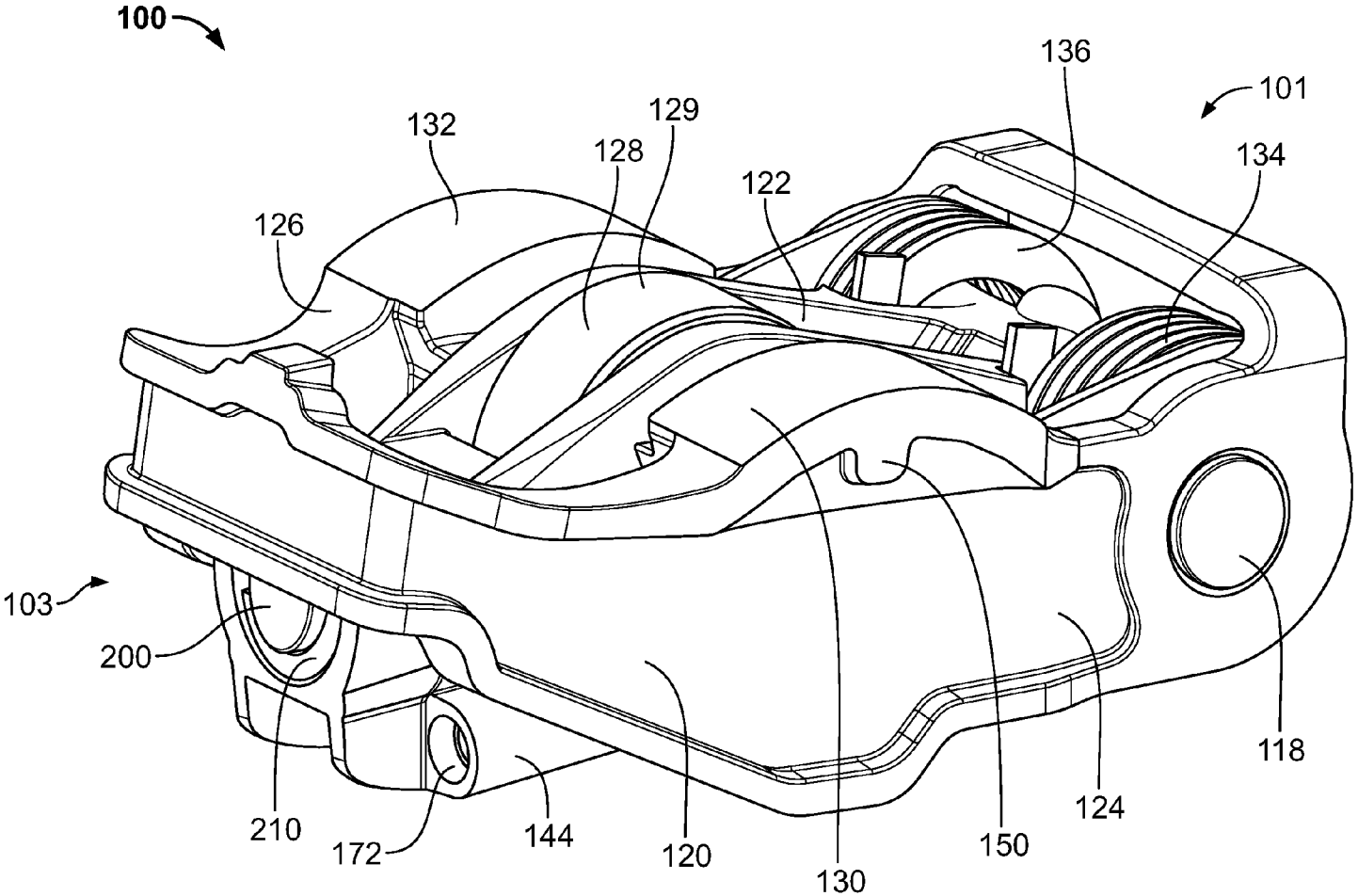
FIG. 3 illustrates another perspective view of an exemplary switching rocker arm 100.

FIG. 3 illustrates another perspective view of the rocker arm 100. A first clamping lobe 150 protrudes from underneath the first slider pad 130. A second clamping lobe (not shown) is similarly placed underneath the second slider pad 132. During the manufacturing process, clamping lobes 150 are engaged by clamps during grinding of the slider pads 130, 132. Grinding of these surfaces requires that the pads 130, 132 remain parallel to one another and that the outer arm 120 not be distorted. Clamping at the clamping lobes 150 prevents distortion that may occur to the outer arm 120 under other clamping arrangements. For example, clamping at the clamping lobe 150, which are preferably integral to the outer arm 120, assist in eliminating any mechanical stress that may occur by clamping that squeezes outer side arms 124, 126 toward one another. In another example, the location of clamping lobe 150 immediately underneath slider pads 130, 132, results in substantially zero to minimal torque on the outer arm 120 caused by contact forces with the grinding machine. In certain applications, it may be necessary to apply pressure to other portions in outer arm 120 in order to minimize distortion.

Figure 4:
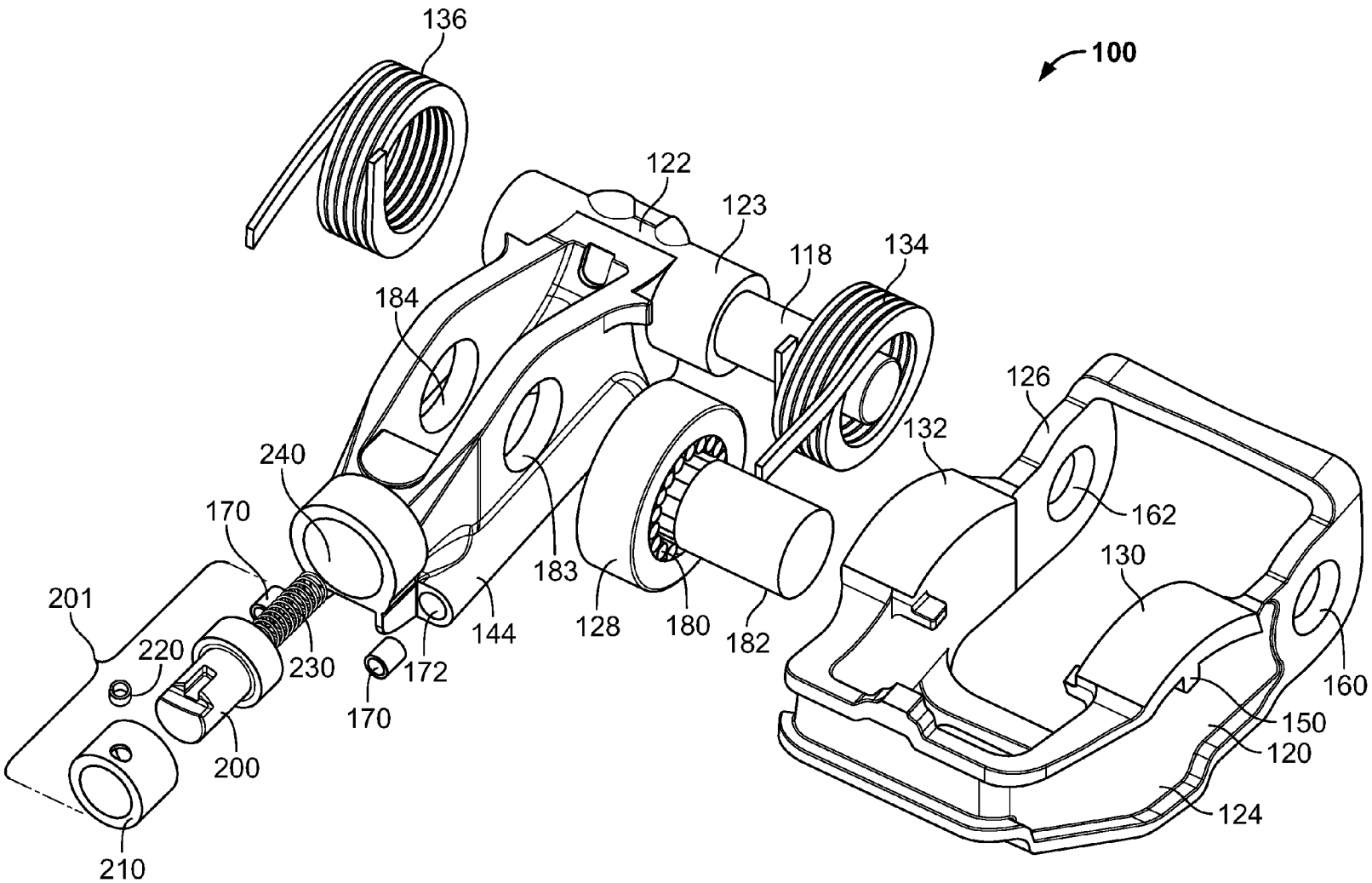
FIG. 4 illustrates an exploded view of an exemplary switching rocker arm 100.

FIG. 4 illustrates an exploded view of the switching rocker arm 100 of FIGS. 2 and 3. As shown in FIG. 4, when assembled, roller 128 is part of a needle roller-type assembly 129, having needles 180 mounted between the roller 128 and roller axle 182. Roller axle 182 is mounted to the inner arm 122 via roller axle apertures 183, 184. Roller assembly 129 serves to transfer the rotational motion of the low-lift cam 108 to the inner rocker arm 120, and in turn transfer motion to the valve 112 in the unlatched state. Pivot axle 118 is mounted to inner arm 122 through collar 123 and to outer arm 120 through pivot axle apertures 160, 162 at the first end 101 of rocker arm 100. Lost motion rotation of the outer arm 120 relative to the inner arm 122 in the unlatched state occurs about pivot axle 118. Lost motion movement in this context means movement of the outer arm 120 relative to the inner arm 122 in the unlatched state. This motion does not transmit the rotating motion of the first and second high-lift lobe 104, 106 of the cam 102 to the valve 112 in the unlatched state.

Other configurations other than the roller assembly 129 and pads 130, 132 also permit the transfer of motion from cam 102 to rocker arm 100. For example, a smooth non-rotating surface (not shown) such as pads 130, 132 may be placed on inner arm 122 to engage low-lift lobe 108, and roller assemblies may be mounted to rocker arm 100 to transfer motion from high-lift lobes 104, 106 to outer arm 120 of rocker arm 100.

The mechanism 201 for latching inner arm 122 to outer arm 120, which in the illustrated embodiment is found near second end 103 of rocker arm 100, is shown in FIG. 4 as comprising latch pin 200, a sleeve or collar 210, orientation pin 221, and latch spring 230. The mechanism 201 is configured to be mounted inside inner arm 122 within bore 240. As explained below, in the assembled rocker arm 100 latch 200 is extended in high-lift mode, securing inner arm 122 to outer arm 120. In low-lift mode, latch 200 is retracted into inner arm 122, allowing lost motion movement of outer arm 120. Oil pressure provided through the first and second oil gallery 144, 146, which may be controlled, for example, by a solenoid, controls whether latch 200 is latched or unlatched. Plugs 170 are inserted into gallery holes 172 to form a pressure tight seal closing first and second oil gallery 144, 146 and allowing them to pass oil to latching mechanism 201.

Figure 5:
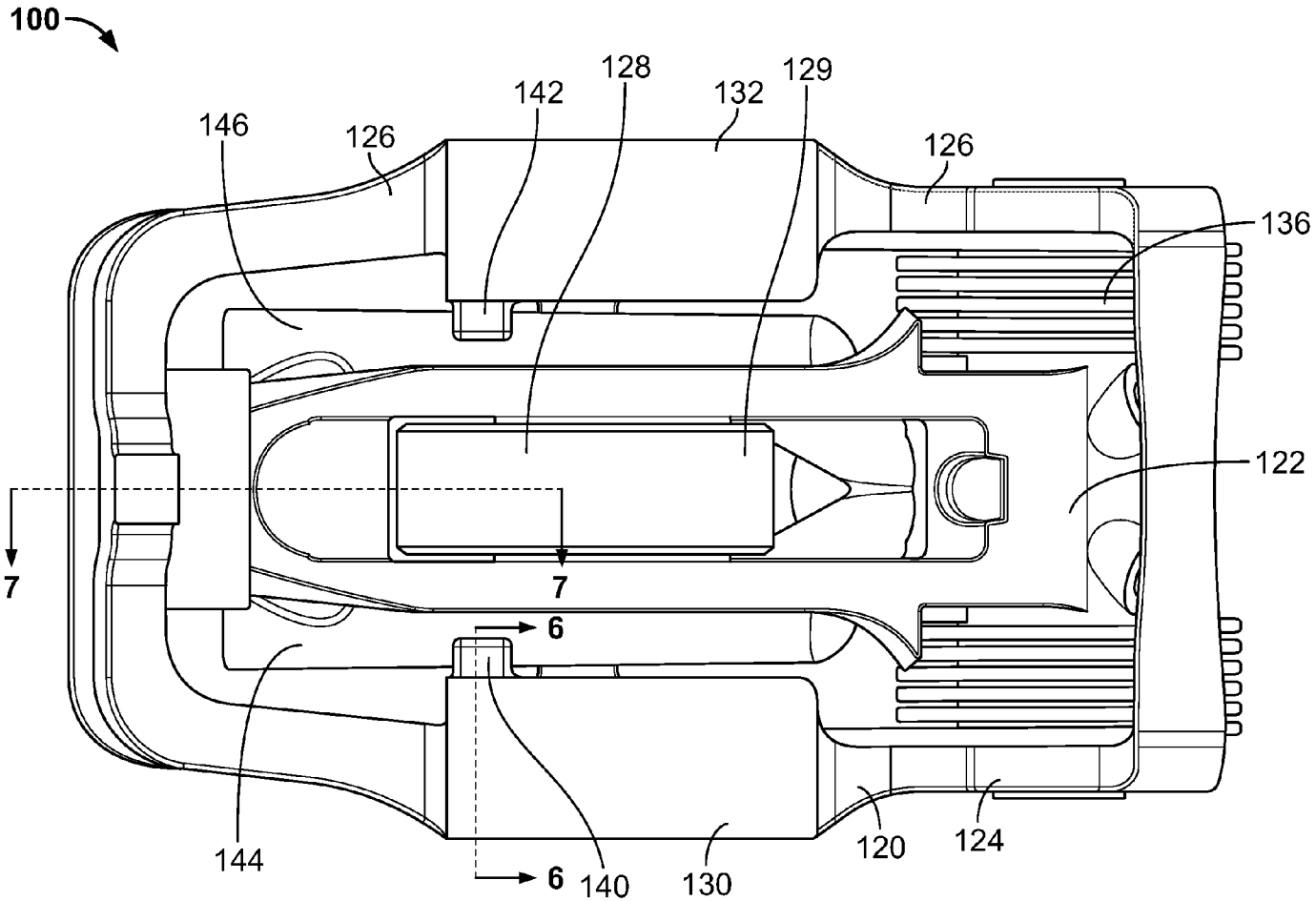
FIG. 5 illustrates a top-down view of exemplary switching rocker arm 100.
Figure 6:
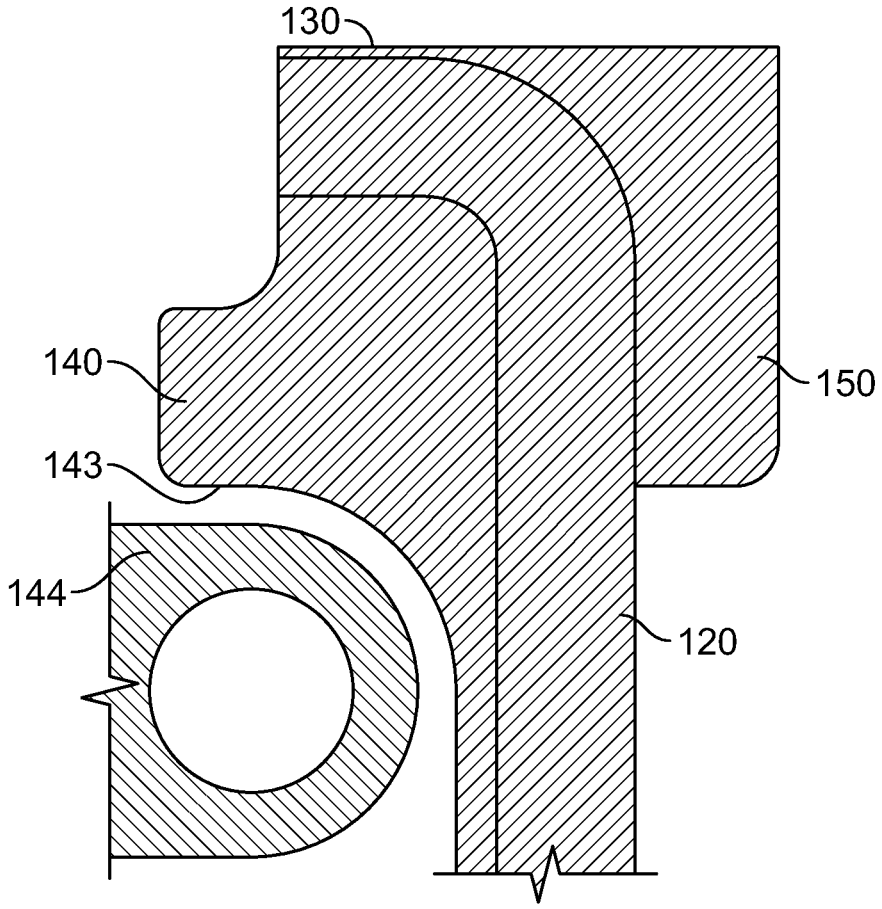
FIG. 6 illustrates a cross-section view taken along line 6-6 in FIG. 5.

FIG. 5 illustrates a top-down view of rocker arm 100. As shown in FIG. 5, over-travel limiters 140, 142 extend from outer arm 120 toward inner arm 122 to overlap with galleries 144, 146, ensuring interference between limiters 140, 142 and galleries 144, 146. As shown in FIG. 6, representing a cross-section view taken along line 6-6, contacting surface 143 of limiter 140 is contoured to match the cross-sectional shape of gallery 144. This assists in applying even distribution of force when limiters 140, 142 make contact with galleries 144, 146.

Figure 7:
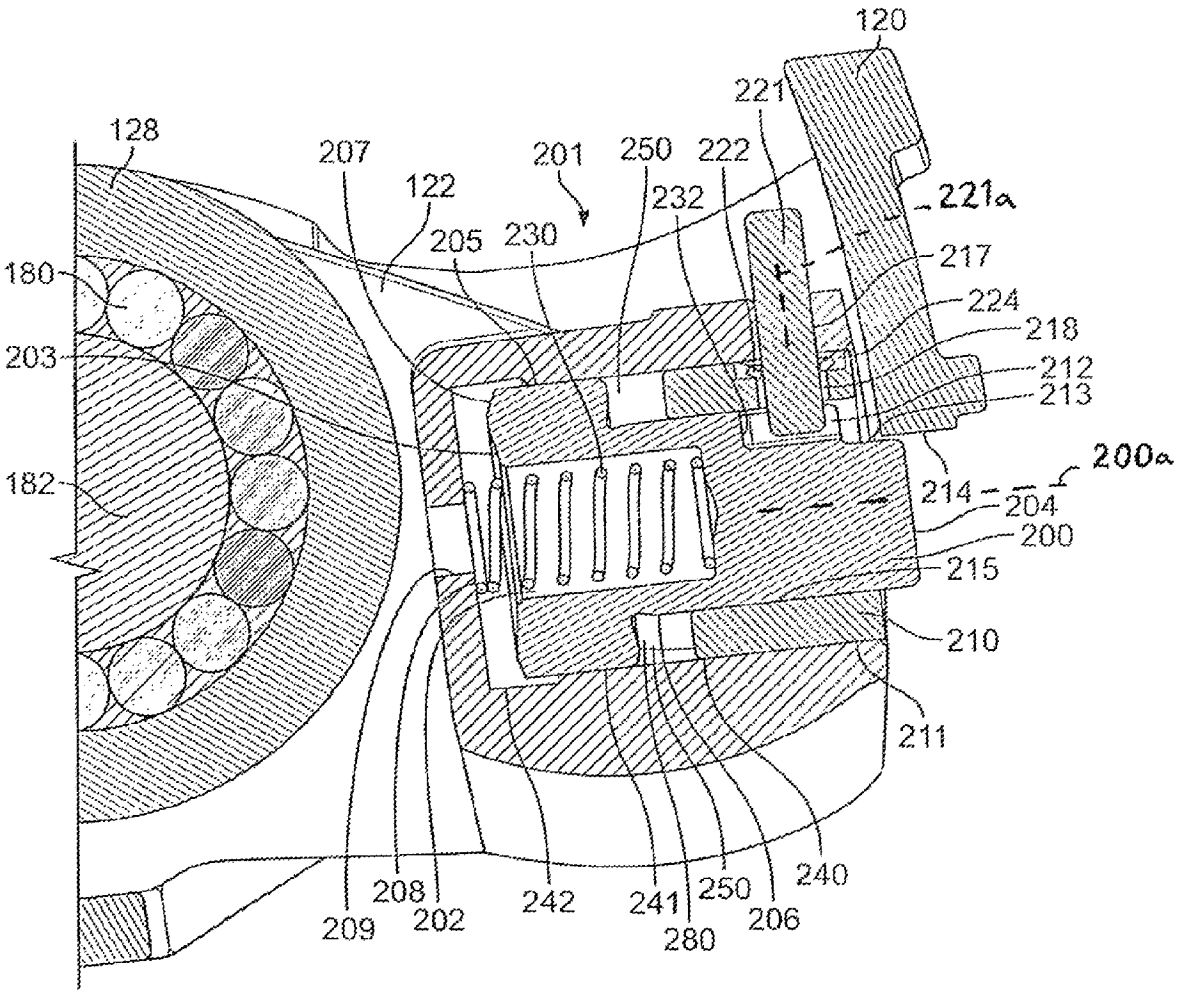
FIG. 7 illustrates a cross-sectional view of the latching mechanism 201 in its latched state along the line 7-7 in FIG. 5.

FIG. 7 illustrates a cross-sectional view of the latching mechanism 201 in its latched state along the line 7-7 in FIG. 5. A latch 200 is disposed within bore 240. Latch 200 has a spring bore 202 in which biasing spring 230 is inserted. The latch 200 has a rear surface 203 and a front surface 204. Latch 200 also has a first generally cylindrical surface 205 and a second generally cylindrical surface 206. The latch 200 extends along a longitudinal latch axis 200*a*. First generally cylindrical surface 205 has a diameter larger than that of the second generally cylindrical surface 206. Spring bore 202 is generally concentric with surfaces 205, 206.

Sleeve 210 has a generally cylindrical outer surface 211 that interfaces a first generally cylindrical bore wall 241, and a generally cylindrical inner surface 215. Bore 240 has a first generally cylindrical bore wall 241, and a second generally cylindrical bore wall 242 having a larger diameter than first generally cylindrical bore wall 241. The generally cylindrical outer surface 211 of sleeve 210 and first generally cylindrical surface 205 of latch 200 engage first generally cylindrical bore wall 241 to form pressure tight seals. Further, the generally cylindrical inner surface 215 of sleeve 210 also forms a pressure tight seal with second generally cylindrical surface 206 of latch 200. These seals allow oil pressure to build in volume 250, which encircles second generally cylindrical surface 206 of latch 200.

Figure 8:
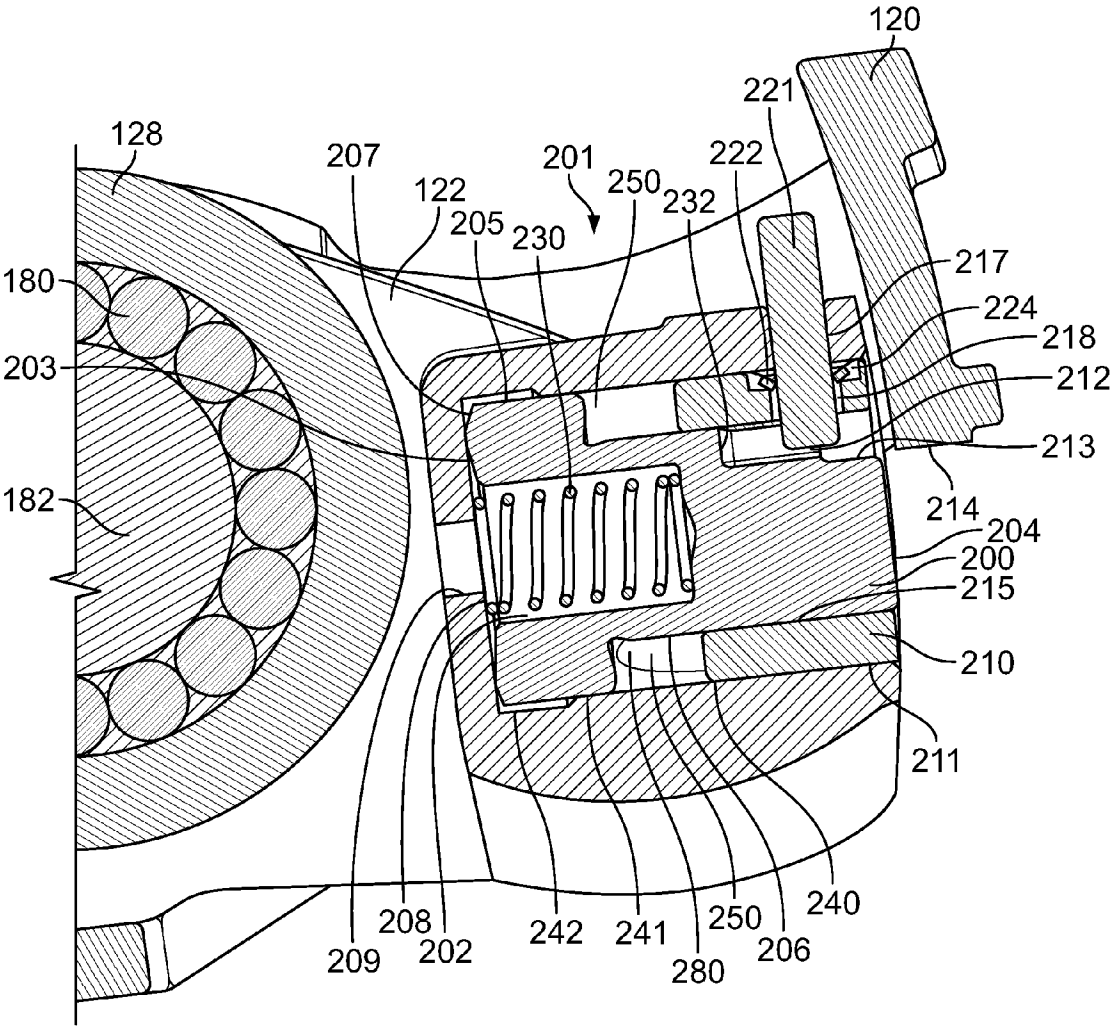
FIG. 8 illustrates a cross-sectional view of the latching mechanism 201 in its unlatched state.

The default position of latch 200, shown in FIG. 7, is the latched position. Spring 230 biases latch 200 outwardly from bore 240 into the latched position. Oil pressure applied to volume 250 retracts latch 200 and moves it into the unlatched position (FIG. 8). Other configurations are also possible, such as where spring 230 biases latch 200 in the unlatched position, and application of oil pressure between bore wall 208 and rear surface 203 causes latch 200 to extend outwardly from the bore 240 to latch outer arm 120.

In the latched state, latch 200 engages a latch engages surface 214 of outer arm 120 with arm engaging surface 213. As shown in FIG. 7, outer arm 120 is impeded from moving downward and will transfer motion to inner arm 122 through latch 200. An orientation feature 212 takes the form of a channel into which orientation pin 221 extends from outside inner arm 122 through first pin opening 217 and then through second pin opening 218 in sleeve 210. The orientation pin 221 extends along a longitudinal orientation pin axis 221*a* that is generally transverse to the longitudinal latch axis 200*a*. The orientation pin 221 is generally solid and smooth. A retainer 222 secures pin 221 in place. The orientation pin 221 prevents excessive rotation of latch 200 around the longitudinal latch axis 200*a* within bore 240.

As can be seen in FIG. 8, upon introduction of pressurized oil into volume 250, latch 200 retracts into bore 240, allowing outer arm 120 to undergo lost motion rotation with respect to inner arm 122. The outer arm 120 is then no longer impeded by latch 200 from moving downward and exhibiting lost motion movement. Pressurized oil is introduced into volume 250 through oil opening 280, which is in fluid communication with oil galleries 144, 146. As latch 200 retracts, it encounters bore wall 208 with its rear surface 203. In one preferred embodiment, rear surface 203 of latch 200 has a flat annular or sealing surface 207 that lies generally perpendicular to first and second generally cylindrical bore wall 241, 242, and parallel to bore wall 208. The flat annular surface 207 forms a seal against bore wall 208, which reduces oil leakage from volume 250 through the seal formed by first generally cylindrical surface 205 of latch 200 and first generally cylindrical bore wall 241.

Figure 9B:
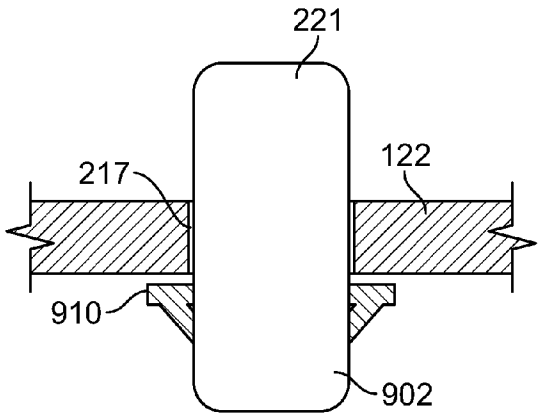
FIGS. 9A-9F illustrate several retention devices for orientation pin 221.
Figure 9C:
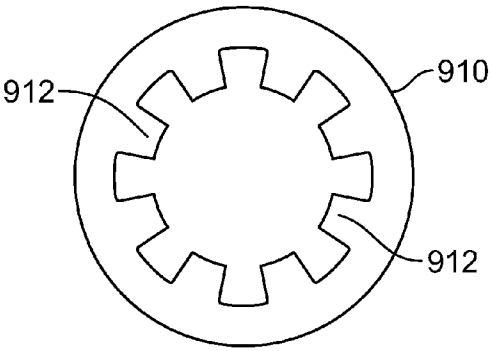
Figure 9A:
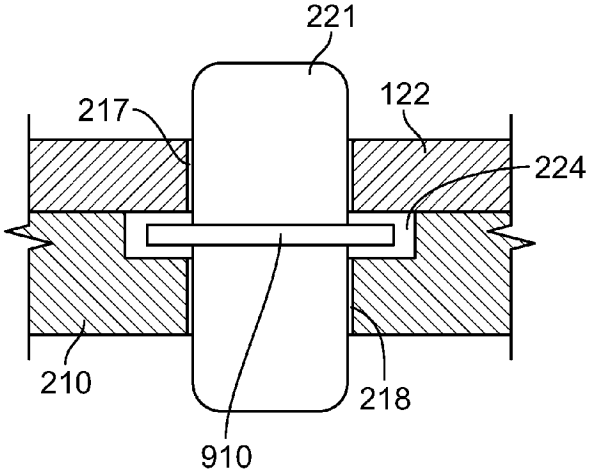
Figure 9E:
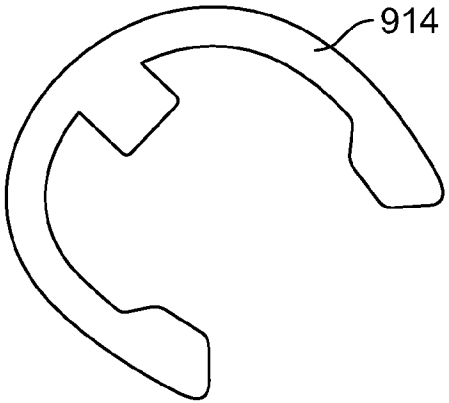
Figure 9D:
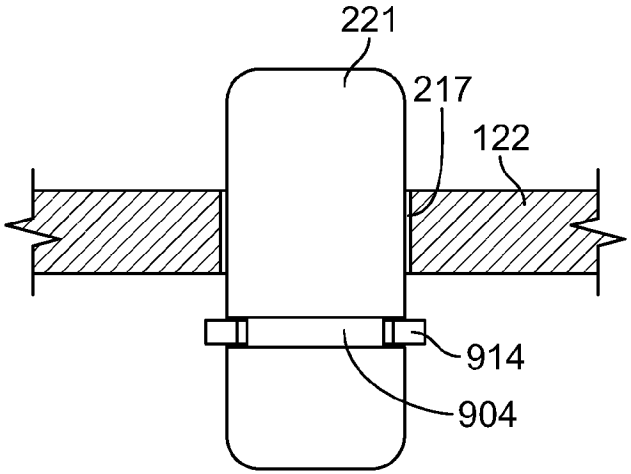
Figure 9F:
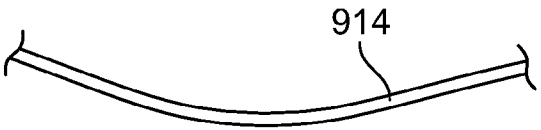

FIGS. 9A-9F illustrate several retention devices for orientation pin 221. In FIG. 9A, pin 221 is cylindrical with a uniform thickness. A push-on ring 910, as shown in FIG. 9C is located in recess 224 located in sleeve 210. Pin 221 is inserted into ring 910, causing teeth 912 to deform and secure pin 221 to ring 910. Pin 221 is then secured in place due to the ring 910 being enclosed within recess 224 by inner arm 122. In another embodiment, shown in FIG. 9B, pin 221 has a slot 902 in which teeth 912 of ring 910 press, securing ring 910 to pin 221. In another embodiment shown in FIG. 9D, pin 221 has a slot 904 in which an E-styled clip 914 of the kind shown in FIG. 9E, or a bowed E-styled clip 914 as shown in FIG. 9F may be inserted to secure pin 221 in place with respect to inner arm 122. In yet other embodiments, wire rings may be used in lieu of stamped rings. During assembly, the E-styled clip 914 is placed in recess 224, at which point the sleeve 210 is inserted into inner arm 122, then, the orientation pin 221 is inserted through the clip 910.

Figure 10:
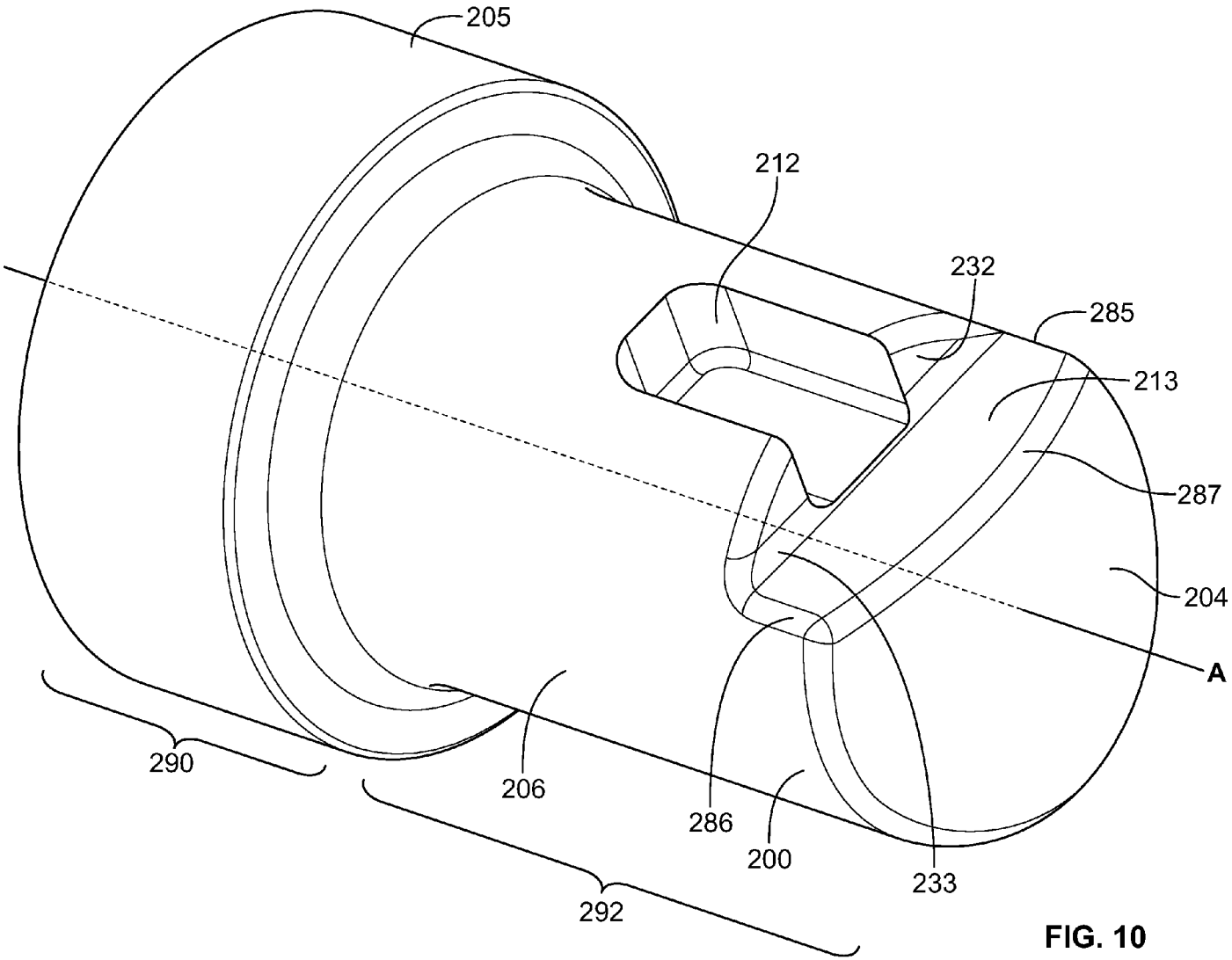
FIG. 10 illustrates an exemplary latch 200.

An exemplary latch 200 is shown in FIG. 10. The latch 200 is generally divided into a head portion 290 and a body portion 292. The front surface 204 is a protruding convex curved surface. This surface shape extends toward outer arm 120 and results in an increased chance of proper engagement of arm engaging surface 213 of latch 200 with outer arm 120. Arm engaging surface 213 comprises a generally flat surface. Arm engaging surface 213 extends from a first boundary 285 with second generally cylindrical surface 206 to a second boundary 286, and from a boundary 287 with the front surface to a boundary 233 with surface 232. The portion of arm engaging surface 213 that extends furthest from surface 232 in the direction of the longitudinal axis A of latch 200 is located substantially equidistant between first boundary 285 and second boundary 286. Conversely, the portion of arm engaging surface 213 that extends the least from surface 232 in the axial direction A is located substantially at first and second boundaries 285, 286. Front surface 204 need not be a convex curved surface but instead can be a v-shaped surface, or some other shape. The arrangement permits greater rotation of the latch 200 within bore 240 while improving the likelihood of proper engagement of arm engaging surface 213 of latch 200 with outer arm 120.

Figure 11:
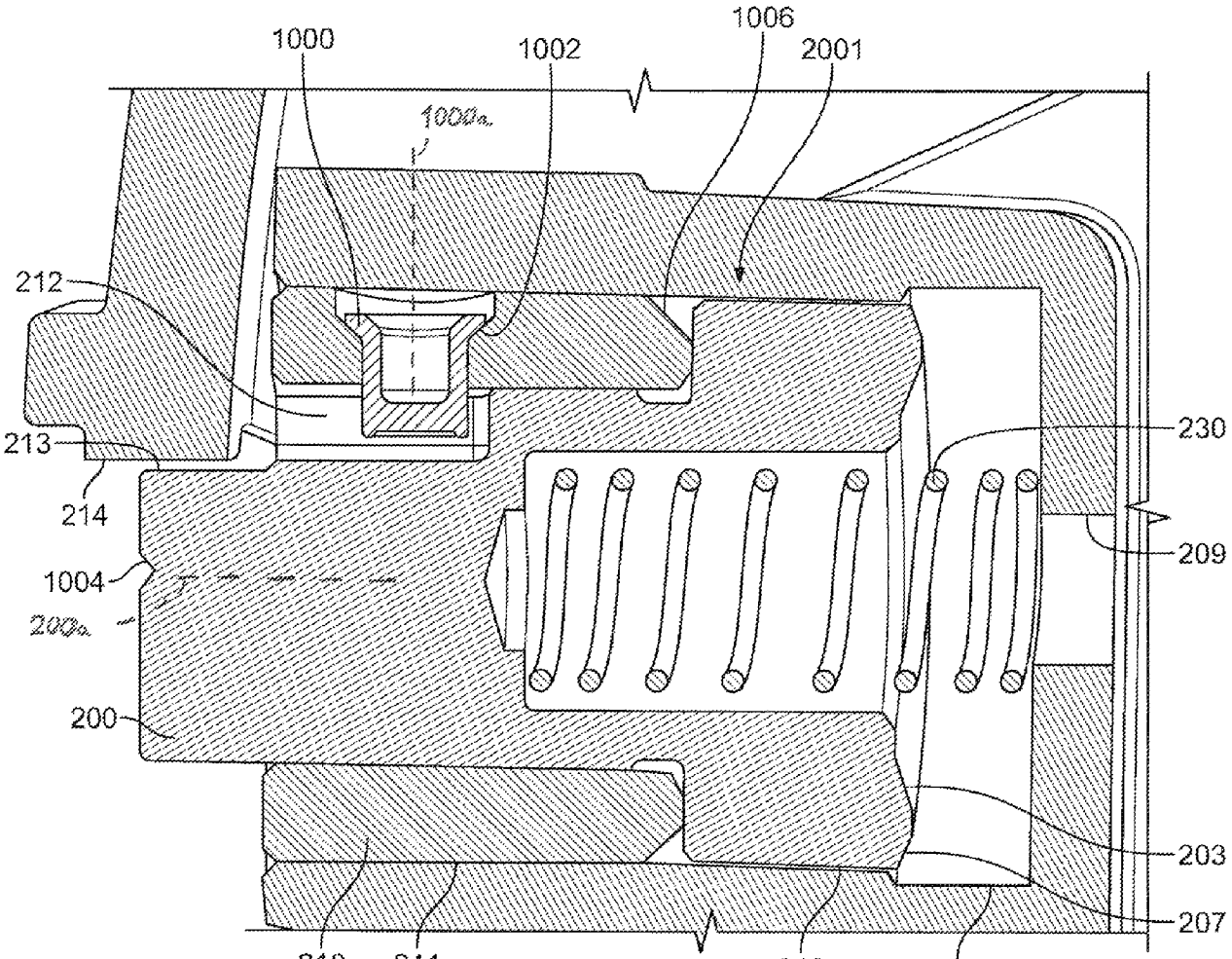
FIG. 11 illustrates an alternative latching mechanism 201.

An alternative latching mechanism 201 is shown in FIG. 11. An orientation plug 1000, in the form of a hollow cup-shaped plug, is press-fit into sleeve hole 100 and orients latch 200 by extending into orientation feature 212, preventing latch 200 from rotating excessively with respect to sleeve 210. The orientation plug 1000 extends along a longitudinal orientation plug axis 1000*a* that is generally transverse to the longitudinal latch axis 200*a*. As discussed further below, an aligning slot 1004 assists in orienting the latch 200 within sleeve 210 and ultimately within inner arm 122 by providing a feature by which latch 200 may be rotated within the sleeve 210. The alignment slot 1004 may serve as a feature with which to rotate the latch 200, and also to measure its relative orientation.

Figure 13:
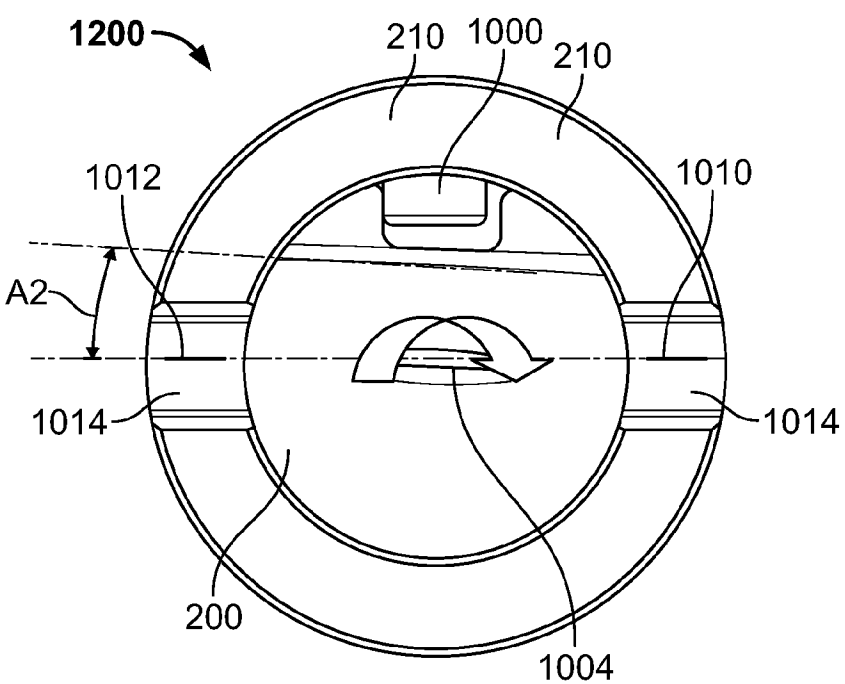
FIGS. 12-14 illustrate an exemplary method of assembling a switching rocker arm.
Figure 12:
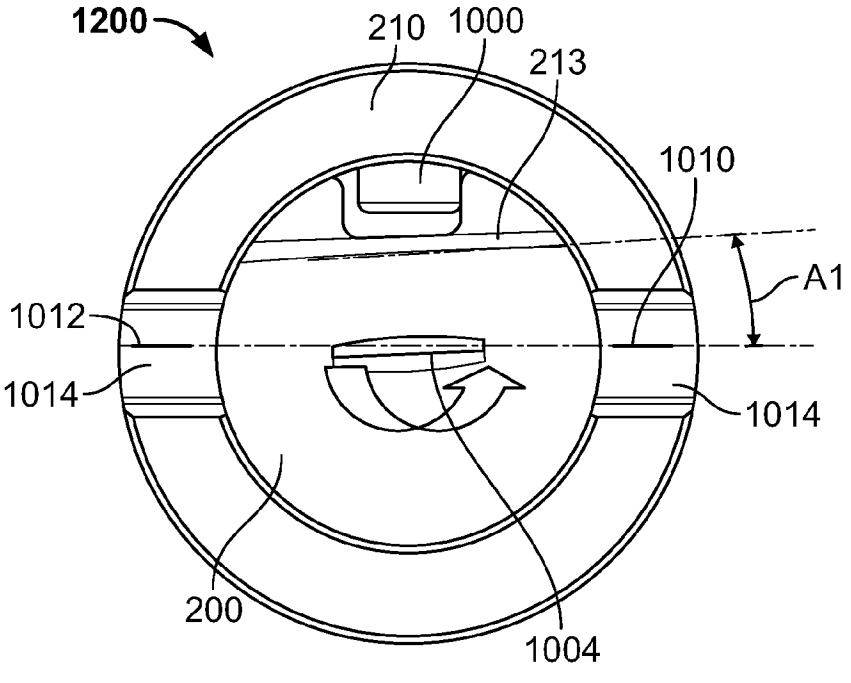
Figure 14:
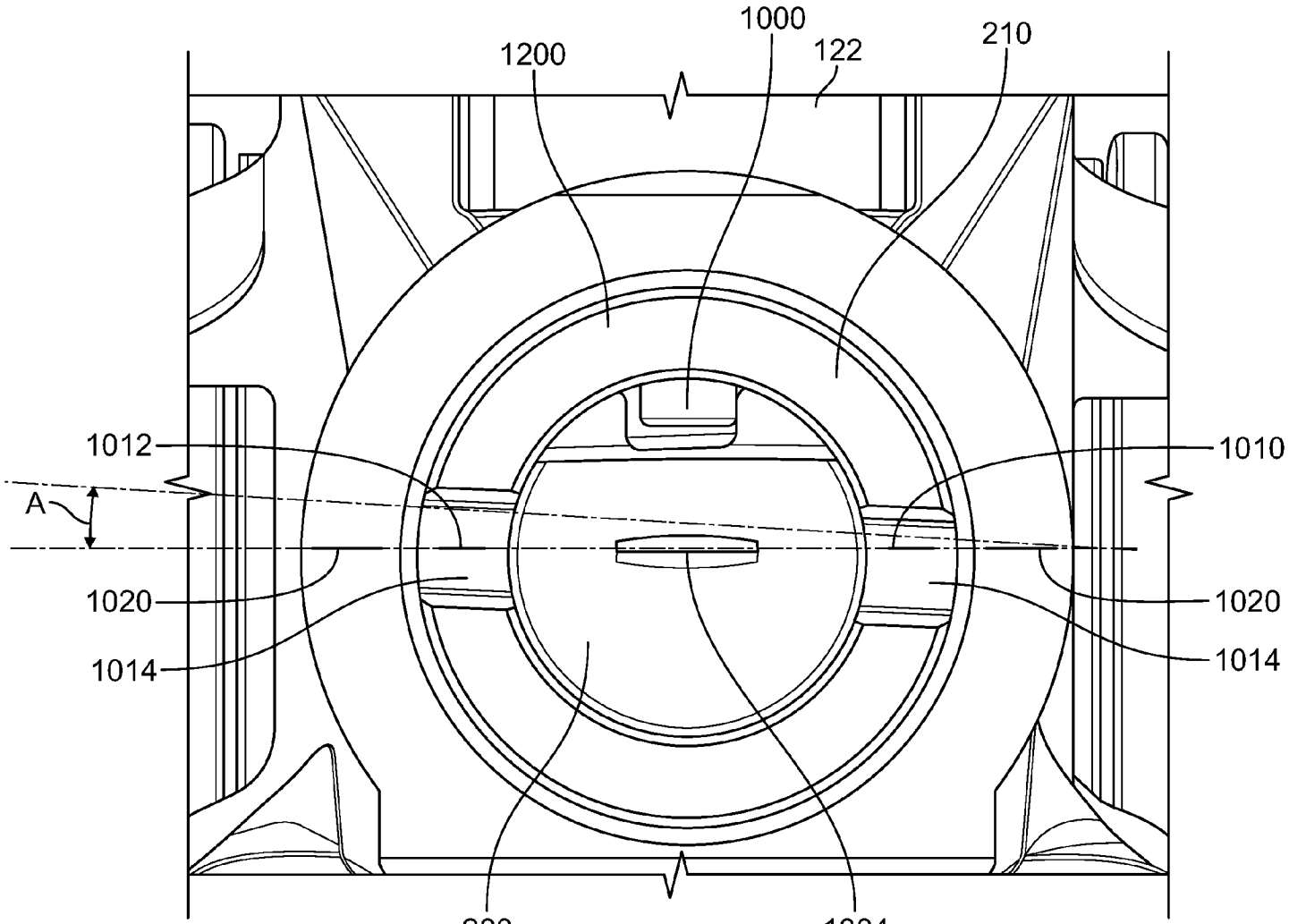

With reference to FIGS. 12-14, an exemplary method of assembling a switching rocker arm 100 is as follows: The orientation plug is press-fit into sleeve hole 1002 and latch 200 is inserted into generally cylindrical inner surface 215 of sleeve 210. The latch 200 is then rotated clockwise until orientation feature 212 reaches plug 1000, at which point interference between the orientation feature 212 and plug 1000 prevents further rotation. An angle measurement A1, as shown in FIG. 12, is then taken corresponding to the angle between arm engaging surface 213 and sleeve references 1010, 1012, which are aligned to be perpendicular to sleeve hole 1002. Aligning slot 1004 may also serve as a reference line for latch 200, and key slots 1014 may also serve as references located on sleeve 210. The latch 200 is then rotated counterclockwise until orientation feature 212 reaches plug 1000, preventing further rotation. As seen in FIG. 13, a second angle measurement A2 is taken corresponding to the angle between arm engaging surface 213 and sleeve references 1010, 1012. Rotating counterclockwise and then clockwise is also permissible in order to obtain A1 and A2. As shown in FIG. 14, upon insertion into the inner arm 122, the sleeve 210 and pin subassembly 1200 is rotated by an angle A as measured between inner arm references 1020 and sleeve references 1010, 1012, resulting in the arm engaging surface 213 being oriented horizontally with respect to inner arm 122, as indicated by inner arm references 1020. The amount of rotation A should be chosen to maximize the likelihood the latch 200 will engage outer arm 120. One such example is to rotate subassembly 1200 an angle half of the difference of A2 and A1 as measured from inner arm references 1020. Other amounts of adjustment A are possible within the scope of the present disclosure.

Figure 15:
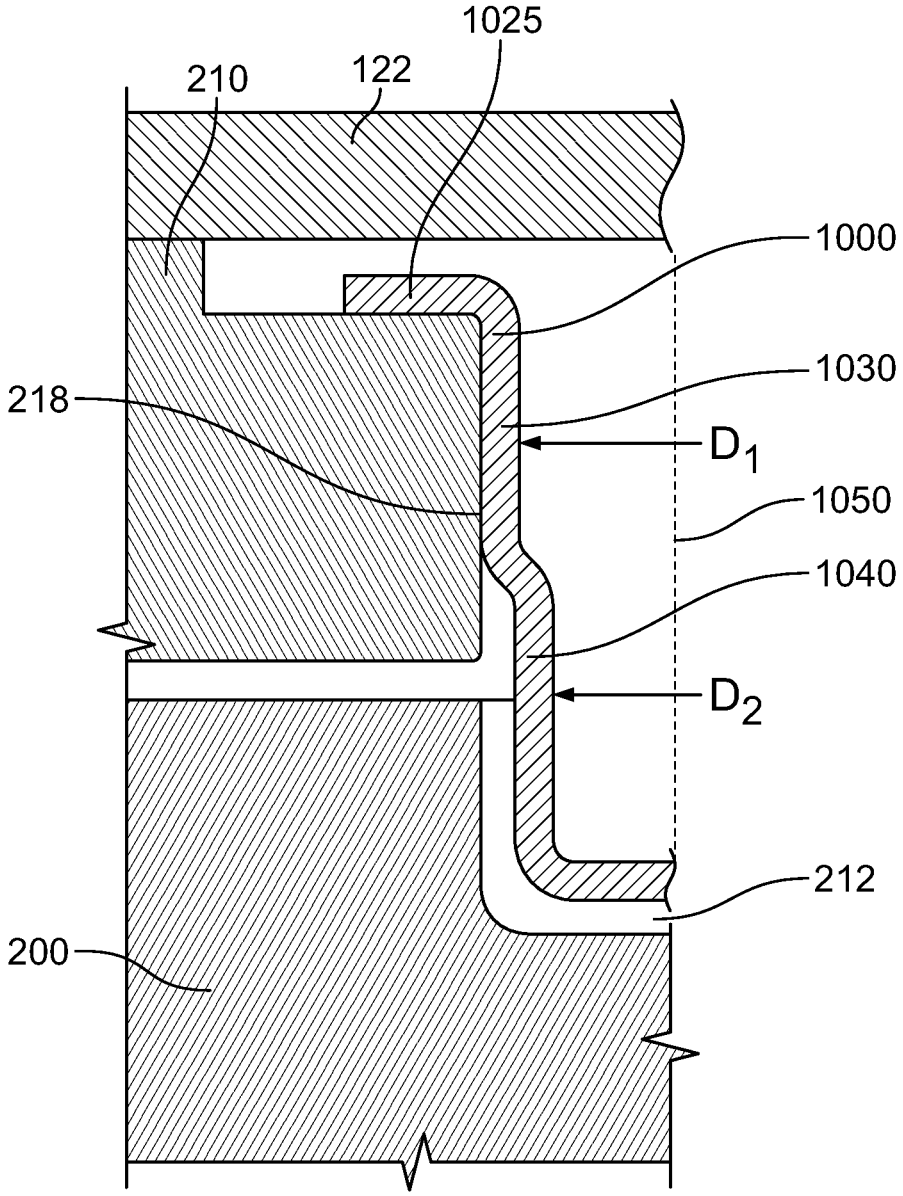
FIG. 15 illustrates an alternative embodiment of pin 1000.

A profile of an alternative embodiment of pin 1000 is shown in FIG. 15. Here, the pin 1000 is hollow, partially enclosing an inner volume 1015. The pin has a substantially cylindrical first wall 1030 and a substantially cylindrical second wall 1040. The substantially cylindrical first wall 1030 has a diameter D1 larger than diameter D2 of second wall 1040. A flange 1025 ensures orientation pin 1000 will not be displaced downwardly through pin opening 218 in sleeve 210.

For the purposes of this disclosure and unless otherwise specified, "a" or "an" means "one or more." To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or multiple components. As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term. From about X to Y is intended to mean from about X to about Y, where X and Y are the specified values.

While the present disclosure illustrates various embodiments, and while these embodiments have been described in some detail, it is not the intention of the applicant to restrict or in any way limit the scope of the claimed invention to such detail. Additional advantages and modifications will readily appear to those skilled in the art. Therefore, the invention, in its broader aspects, is not limited to the specific details and illustrative examples shown and described. Accordingly, departures may be made from such details without departing from the spirit or scope of the applicant's claimed invention. Moreover, the foregoing embodiments are illustrative, and no single feature or element is essential to all possible combinations that may be claimed in this or a later application.

The invention claimed is:

1. A method for orienting a latch in a switching rocker arm having a first arm and a second arm having a latch bore, the method comprising:

providing a latch having a first arm contacting surface configured to engage the first arm and further having a latch orientation reference;

providing a sleeve having an opening configured for insertion of a latch and further having a sleeve orientation reference;

inserting the latch into the opening of the sleeve to form a latch subassembly;

rotating the latch relative to the sleeve until the latch orientation reference has a predetermined orientation with the sleeve orientation reference;

inserting the latch subassembly into the latch bore of the second arm based on the latch orientation reference having the predetermined orientation with the sleeve orientation reference.

2. The method of claim 1 further comprising:

providing an orientation plug;

inserting the orientation plug into a plug aperture formed in the sleeve.

3. The method of claim 2, wherein the step of inserting the orientation plug occurs prior to the step of inserting the latch into the sleeve.

4. The method of claim 1, further comprising:

rotating the latch within the sleeve in a first direction until the latch interferes with orientation plug;

determining a first angle between the first arm contacting surface and the sleeve orientation reference;

rotating the latch within the sleeve in a second direction opposite the first direction until the latch interferes with the orientation plug;

determining a second angle between the first arm contacting surface and the sleeve orientation reference;

adjusting an orientation of the latch based on the first and second angles.

5. The method of claim 4, wherein the adjusting step comprises rotating the latch in one of a first or second direction by an angle substantially equal to one half of the difference of the first angle and second angle.

6. A method for orienting a latch in a switching rocker arm, the method comprising:

providing an orientation plug that extends along a longitudinal orientation plug axis and a sleeve having generally cylindrical inner and outer surfaces and an orientation plug opening extending from the generally cylindrical inner surface to the generally cylindrical outer surfaces;

inserting the orientation plug into the orientation plug opening and applying sufficient pressure to press fit the orientation plug within the opening, thereby securing the orientation plug to the sleeve;

providing a latch having a generally cylindrical head at a first end and a generally cylindrical body extending from the head toward a second end of the latch in an axial direction, and an orientation plug receiving recess adjacent its second end;

inserting the latch into the sleeve such that at least a portion of the body is in contact with the inner surface of the sleeve and the orientation plug is received in the orientation plug receiving recess wherein the latch moves along the axial direction relative to the sleeve and wherein the longitudinal orientation plug axis is transverse to the axial direction.

7. The method of claim 6, further comprising:

providing the latch further having a latch orientation reference on the second end of the latch;

providing the sleeve further having a first end, a second end and a sleeve orientation reference on the second end;

rotating the latch relative to the sleeve in a first direction until the orientation plug interferes with the orientation pin receiving recess;

determining a first angle between the latch orientation reference and the sleeve orientation reference.

8. The method of claim 7, further comprising:

rotating the latch relative to the sleeve in a second direction opposite the first direction until the orientation plug interferes with the orientation pin receiving recess;

determining a second angle between the latch orientation reference and the sleeve orientation reference.

9. The method of claim 8, further comprising:

rotating the latch relative to the sleeve wherein the angle between the latch orientation reference and the sleeve orientation reference is between the first angle and the second angle.

10. The method of claim 9, further comprising:

providing the rocker arm further having a bore configured for insertion of a latch and sleeve;

inserting the latch and sleeve into the rocker arm;

orienting one of the latch orientation reference mark and the sleeve orientation reference mark with a rocker arm reference mark.

11. The method of claim 8, further comprising:

adjusting an orientation of the latch based on the first and second angles.

12. The method of claim 11 wherein the adjusting step comprises rotating the latch in one of a first or second direction by an angle substantially equal to one half of the difference of the first angle and second angle.

13. A rocker arm for engaging a cam, comprising:

an outer arm having a first end, a second end, a first and second outer side arm;

an inner arm disposed between the first and second outer side arms, having a first end, a second end and a cam contacting surface disposed between the first and second ends;

the inner arm pivotably secured adjacent its first end to the outer arm adjacent the first end of the outer arm, the inner arm having a latch bore adjacent its second end having a generally cylindrical wall and a bore wall;

a latch having a head with a first generally cylindrical diameter, a body with a second generally cylindrical diameter smaller than the first generally cylindrical diameter and an orientation feature, the first and second cylindrical diameters extending along a common longitudinal axis;

a sleeve separately formed from the inner arm and the latch and having generally cylindrical inner and outer surfaces, the outer surface at least partially engaging the generally cylindrical wall of the latch bore, the inner surface at least partially engaging the body of the latch wherein the latch moves along the longitudinal latch axis relative to the sleeve, the sleeve having an orientation plug aperture extending between generally cylindrical inner and outer surfaces;

an orientation plug that extends along a longitudinal orientation plug axis that is transverse to the longitudinal latch axis, the orientation plug extending through the sleeve into the orientation feature, wherein, the orientation plug restricts rotation of the latch about the longitudinal latch axis.

14. The apparatus of claim 13 wherein the plug is press fit into the orientation feature.

15. The apparatus of claim 13 wherein the plug is hollow.

16. The apparatus of claim 13 wherein the plug comprises a first and second substantially cylindrical walls, the first substantially cylindrical wall having a diameter larger than the second substantially cylindrical wall, the second substantially cylindrical wall extending into the orientation pin receiving recess.

17. The apparatus of claim 16 wherein the plug comprises a flange extending radially from the first substantially cylindrical wall, the flange disposed adjacent the outer surface of the sleeve.

18. The apparatus of claim 13 wherein one of the inner arm, sleeve and latch has a reference marking configured to orient the latch with respect to at least one of the inner arm and sleeve.

19. The apparatus of claim 18 wherein the sleeve has a reference marking configured to orient the latch with respect to the sleeve.

20. The apparatus of claim 18 wherein the inner arm has a reference marking configured to orient the latch with respect to the inner arm.

* * * * *